US006781504B2

(12) United States Patent
Scott et al.

(10) Patent No.: US 6,781,504 B2
(45) Date of Patent: Aug. 24, 2004

(54) THERMAL SWITCH ADAPTER

(75) Inventors: Byron G. Scott, Arlington, WA (US); George D. Davis, Bellevue, WA (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/198,262

(22) Filed: Jul. 16, 2002

(65) Prior Publication Data

US 2003/0034872 A1 Feb. 20, 2003

Related U.S. Application Data

(60) Provisional application No. 60/312,386, filed on Aug. 14, 2001.

(51) Int. Cl.[7] ..... H01H 37/04; H01H 37/06

(52) U.S. Cl. ..... 337/380; 337/398; 337/415

(58) Field of Search ..... 337/112, 325, 337/327, 380, 398, 415

(56) References Cited

U.S. PATENT DOCUMENTS

| | | | | | |
|---|---|---|---|---|---|
| 2,273,381 | A | * | 2/1942 | Shaw | 337/359 |
| 2,907,851 | A | * | 10/1959 | Moorhead et al. | 337/377 |
| 3,414,225 | A | * | 12/1968 | Lester | 248/506 |
| 3,748,888 | A | | 7/1973 | Gerich | 72/375 |
| 3,933,022 | A | | 1/1976 | Peltz | 72/342 |
| 4,268,812 | A | * | 5/1981 | Satterlee | 337/380 |
| 4,297,668 | A | * | 10/1981 | Place | 337/365 |
| 4,346,274 | A | * | 8/1982 | Mutschler et al. | 200/296 |
| 4,446,450 | A | * | 5/1984 | Boulanger et al. | 337/380 |
| 4,446,451 | A | * | 5/1984 | Boulanger | 337/380 |
| 4,626,821 | A | * | 12/1986 | Versaw | 337/380 |
| 4,641,121 | A | * | 2/1987 | Boulanger | 337/380 |
| 4,926,148 | A | * | 5/1990 | Cambreleng | 335/13 |
| 5,126,510 | A | * | 6/1992 | Bauer et al. | 174/52.1 |
| 5,250,209 | A | | 10/1993 | Jamison et al. | 252/74 |
| 5,307,543 | A | * | 5/1994 | Krillenberger | 24/543 |
| 5,591,034 | A | | 1/1997 | Ameen et al. | 439/91 |
| 5,670,930 | A | * | 9/1997 | Hofsass, deceased et al. | 337/380 |
| 5,699,033 | A | * | 12/1997 | Hofsass | 337/380 |
| 5,864,279 | A | * | 1/1999 | Becher et al. | 337/380 |
| 5,870,014 | A | * | 2/1999 | Nield et al. | 337/362 |
| 6,302,361 | B1 | * | 10/2001 | Schaefer et al. | 248/27.3 |
| 6,334,707 | B1 | * | 1/2002 | Ku | 374/208 |
| 6,417,758 | B1 | * | 7/2002 | Russell et al. | 337/380 |
| 6,507,267 | B2 | * | 1/2003 | Russell et al. | 337/380 |
| 6,550,962 | B1 | * | 4/2003 | Yang et al. | 374/147 |

FOREIGN PATENT DOCUMENTS

DE 2719194 A1 * 11/1978 ..... H01H/009/02

* cited by examiner

*Primary Examiner*—Anatoly Vortman
(74) *Attorney, Agent, or Firm*—Charles J. Rupnick

(57) ABSTRACT

A thermal switch apparatus having an adapter mount that snaps to a modular thermal switch by hand or with the use of a simple tool. The thermal switch apparatus of the invention is embodied as a thermal switch apparatus including an adapter having a mounting apparatus and a receptacle, the receptacle having a female portion structured internally with a retainer. A modular thermal sensing device includes a male portion sized to enter the female portion of the receptacle, the male portion having an external relief structured to interlock with the internal retainer of the female portion. The male portion of the modular thermal sensing device is installed into the female portion of the receptacle, the retainer of the receptacle being mated with the external relief of the modular thermal sensing device.

21 Claims, 7 Drawing Sheets

THERMAL SWITCH ADAPTER

This application claims the benefit of U.S. Provisional Application Ser. No. 60/312,386, filed in the names of Byron G. Scott and George D. Davis on Aug. 14, 2001, the complete disclosure of which is incorporated herein by reference.

FIELD OF THE INVENTION

The present invention relates to mounting adapters, and in particular to snap on mounting adapters for thermal sensing switches.

BACKGROUND OF THE INVENTION

Thermal sensing electrical switching devices, or thermal switches, of various configurations are generally well known. For example, thermocouples, resistive thermal devices (RTDs) and thermistors are used for measuring temperature in various applications. Such sensors provide an electrical analog signal, such as a voltage or a resistance, which changes as a function of temperature. Monolithic temperature sensors are also known. For example, a diode connected bipolar transistor can be used for temperature sensing. More specifically, a standard bipolar transistor can be configured with the base and emitter terminals shorted together. With such a configuration, the base collector junction forms a diode. When electrical power is applied, the voltage drop across the base collector junction varies relatively linearly as a function of temperature. Thus, such diode connected bipolar transistors have been known to be incorporated into various integrated circuits for temperature sensing. Such devices are useful in providing relatively accurate temperature measurements; however, they are generally not used in control applications to control electrical equipment.

Precision thermostats are generally used in such control applications. The thermal switch is one form of precision thermostat used in control applications to switch on or off heaters, fans, and other electrical equipment at specific temperatures. Such temperature switches typically consist of a sensing element which provides a displacement as a function of temperature and a pair of electrical contacts. The sensing element is typically mechanically interlocked with the pair of electrical contacts to either make or break the electrical contacts at predetermined temperature set points. The temperature set points are defined by the particular sensing element utilized.

Various types of sensing elements are known which provide a displacement as a function of temperature. For example, mercury bulbs, magnets and bi-metallic elements are known to be used in such temperature switches. Mercury bulb thermal sensors have a mercury filled bulb and an attached glass capillary tube which acts as an expansion chamber. Two electrical conductors are disposed within the capillary at a predetermined distance apart. The electrical conductors act as an open contact. As temperature increases, the mercury expands in the capillary tube until the electrical conductors are shorted by the mercury forming a continuous electrical path. The temperature at which the mercury shorts the electrical conductors is a function of the separation distance of the conductors.

Magnetic reed switches have also been known to be used as temperature sensors in various thermal switches. Such reed switch sensors generally have a pair of toroidal magnets separated by a ferrite collar and a pair of reed contacts. At a critical temperature known as the Curie point, the ferrite collar changes from a state of low reluctance to high reluctance to allow the reed contacts to open.

Bi-metallic thermal switch elements typically consist of two strips of materials having different rates of thermal expansion fused into one bi-metallic disc-shaped element. Precise physical shaping of the disc element and unequal expansion of the two materials cause the element to change shape rapidly at a predetermined set-point temperature. The change in shape of the bi-metal disc is thus used to activate a mechanical switch. The bi-metallic disc element is mechanically interlocked with a pair of electrical contacts such that the rapid change in shape can be used to displace one or both of the electrical contacts to either make or break an electrical circuit. The electrical contacts may be provided as individual components mounted in a base structure, commonly known as a "header," or integrated into a conventional microswitch such that the necessity of assembling discrete components is substantially obviated. Examples of such of formations are described in U.S. Pat. Nos. 3,748,888 and 3,933,022, each of which is incorporated herein by reference in its entirety, wherein a thermally responsive, snap-action bi-metallic disc is provided.

FIG. 1 is a cross-sectional view that illustrates one known modular bi-metallic thermal switch device 10 having a bi-metallic disc actuator 12 positioned to drive relatively movable electrical contacts 14 and 16. The bi-metallic disc actuator 12 is embodied as a thermally responsive, snap-action bimetallic disc actuator that provides a snap force F generated during transit between bi-stable states at a predetermined set-point temperature. The electrical contacts 14, 16 are mounted on the ends of a pair of spaced-apart, electrically conductive terminal posts 20, 22 that are mounted in a header 24 such that they are electrically isolated from one anther. For example, terminal posts 20, 22 are mounted in the metallic header 24 using a glass or epoxy electrical isolator (not shown).

As illustrated in FIG. 1, the movable contact 16 is affixed to an electrically conductive carrier 28 that is embodied as an armature formed of an electrically conductive spring material. The armature 28 is affixed in turn in a cantilever fashion to the electrically conductive terminal post 22 such that a spring pressure S of the armature 28 operates to bias the movable contact 16 toward the fixed contact 14 to make electrical contact therewith. The electrical contacts 14, 16 thus provide an electrically conductive path between the terminal posts 20, 22 such that the terminal posts 20, 22 are shorted together.

The disc actuator 12 is spaced away from the header 24 by a spacer ring 30 interfitted with a peripheral groove 32. A substantially cylindrical case 34 fits over the spacer ring 30, thereby enclosing the terminal posts 20, 22, the electrical contacts 14, 16, and the disc actuator 12. The case 34 includes a base 36 with a pair of annular steps or lands 38 and 40 around the interior thereof and spaced above the base 36. The lower edge of the spacer ring 30 abuts the upper case land 40. A peripheral edge portion 42 of the disc actuator 12 is captured within an annular groove created between the lower end of the spacer ring 30 and the lower case land 38. The disc actuator 12 operates the armature spring 28 to separate the contacts 14, 16 through the distal end 44 of an intermediary striker pin 46 fixed to the armature spring 28. Separation of the contacts 14 and 16 creates an open circuit condition.

FIG. 2 is a cross-sectional view that illustrates another known modular bi-metallic thermal switch device 50 having the bi-metallic disc actuator 12 positioned to drive relatively movable electrical contacts (not shown) within a conventional microswitch 52. The closing and opening of the contacts respectively shorts together terminal posts 54, 56 to create a closed circuit condition or separates the contacts to create an open circuit condition. The disc actuator 12 is mounted on the annular step or land 38 around the interior thereof and spaced above the base 36 of the cylindrical case 34. According to one embodiment, a lower edge of a spacer ring 58 abuts the upper case land 40 and captures the peripheral edge portion 42 of the disc actuator 12 within an annular groove created between the lower end of the spacer ring 58 and the lower case land 38. The spacer ring 58 spaces the microswitch 52 away from the disc actuator 12 to an extent that the disc actuator 12 is positioned in operational relationship with the electrical contacts through the distal end 60 of an intermediary striker pin 62 projecting from the casing of the microswitch 52. An adhesive joint 64 fixes the microswitch 52 within the case 34 and secures the operational relationship with the disc actuator 12.

Often, the thermal switch devices 10, 50 are constructed and stocked in inventory as modular units, as shown in FIGS. 1 and 2, and mated with a mounting adapter 66 configured to match a particular application. For example, mounting adapters 66 are provided as flanged (shown), studded, or tubular adapters. Such mounting hardware is typically manufactured and stocked as separate components to maximize flexibility with minimum inventory. When a thermal switch having a specific response temperature is desired, the appropriate thermal switch module 10, 50 is selected from the inventory of modular units, and the mounting adapter 66 is selected to adapt the thermal switch module 10, 50 to the particular application.

In general, the thermal switch module 10, 50 is mated with the flanged, studded or other mounting adapter 66 at the time the device is ordered. Presently, the mounting adapter 66 is attached to the switch module 10, 50 by adhesive bonding (shown, using a known potting compound to form an adhesive joint 68) or other time-intensive methods, such as spot welding. The mating process thus delays order shipment and adds additional cost to the finished thermal switch product.

SUMMARY OF THE INVENTION

The present invention provides a method and apparatus for quick mating of modular thermal switch devices with different mounting hardware by providing a snap action interlocking mechanism, in contrast to the prior art devices and methods.

The apparatus and method of the present invention is a thermal switch apparatus having an adapter mount that snaps to a modular thermal switch by hand or with the use of a simple tool. The invention facilitates rapid, low cost assembly and shipment of thermal switch devices adapted to a predetermined external apparatus.

According to one aspect of the invention, the apparatus of the invention is embodied as a thermal switch apparatus including an adapter having a mounting apparatus and a receptacle, the receptacle having a female portion structured internally with a retainer; and a modular thermal sensing device having a male portion sized to enter the female portion of the receptacle, the male portion having an external relief structured to interlock with the internal retainer of the female portion.

According to another aspect of the invention, the male portion of the thermal sensing device is installed in the female portion of the adapter with the external relief being interlocked with the retainer.

According to another aspect of the invention, the external relief of the thermal sensing device is embodied as one or more recesses receded into an external surface of the male portion; and the retainer of the adapter is embodied as one or more projections extending inwardly of an interior wall portion of the receptacle, the projections cooperating with the recesses to secure the male portion of the thermal sensing device within the female portion of the receptacle.

According to another aspect of the invention, the retainer is embodied as an integral portion of the female portion of the receptacle.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF PREFERRED EMBODIMENT

In the Figures, like numerals indicate like elements.

The present invention is an apparatus and method for quick mating of thermal switches with desired mounting hardware. The present invention provides a modular thermal switch and an adapter mount that snaps to the thermal switch by hand or with the use of a simple tool. The thermal switch module of the present invention includes an outer case having an external surface that is structured with a relief. The adapter of the present invention is structured with a mounting apparatus and a tubular receptacle having an inside diameter slightly larger than an outside diameter of the thermal switch module's outer case and an internal surface being formed with a retainer structured to mate with the relief on the external surface of the thermal switch module's outer case. According to one embodiment of the invention, the outer case of the thermal switch module contains a thermally responsive bi-metallic disc actuator positioned to drive relatively movable electrical contacts, and the relief on the external surface of the outer case is positioned adjacent to the disc actuator. The present invention thereby facilitates rapid assembly and shipment of thermal switch devices, at a lower cost than similarly mounted prior art devices.

Figure 3:
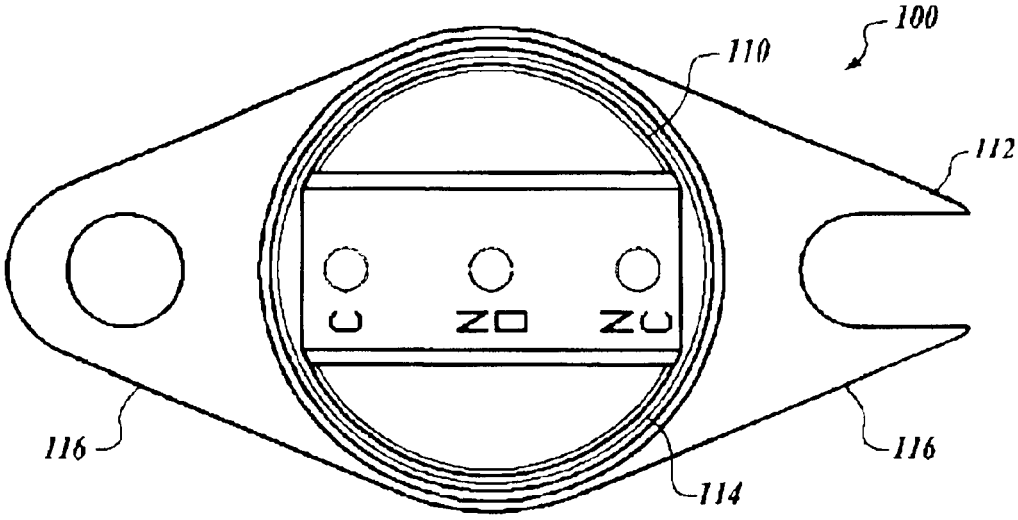
FIG. 3 is a top plan view of the assembled thermal switch apparatus of the invention embodied as a modular bi-metallic thermal switch device having a bimetallic disc actuator positioned to drive relatively movable electrical contacts, the modular thermal switch device being installed in a substantially tubular receptacle of an adapter of the invention embodied as a flanged adapter having a mounting apparatus configured as a pair of wings for securing the thermal switch apparatus of the invention to a surface whose temperature is to be measured.
Figure 4:
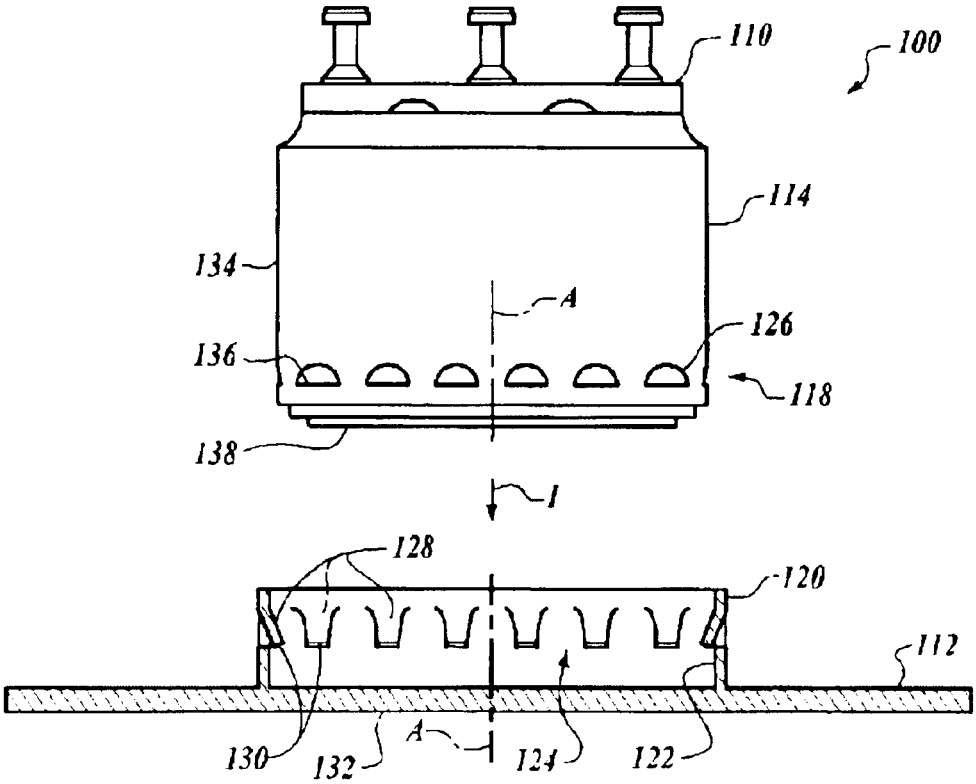
FIG. 4 is a side view of the assembly of the thermal switch apparatus of the invention embodied as shown in FIG. 3, wherein the flanged adapter of the invention is shown in cross-section.

FIGS. 3 and 4 illustrate the thermal switch apparatus 100 of the invention embodied as a modular thermal switch device 110 coupled with an adapter 112. FIG. 3 is a top plan view of the assembled thermal switch apparatus 100 of the invention, and FIG. 4 is a side view of the modular thermal switch device 110 of the invention shown in FIG. 3, with a cross-sectional view of the adapter 112 of the invention. While the modular thermal switch device 110 can be any of the above described thermal sensing electrical switching devices, or thermal switches, it is preferably one of the devices having a thermally responsive, snap-action bimetallic disc actuator that is operatively positioned for opening or closing relatively moveable electrical contacts at a predetermined set-point temperature, the disc actuator and electrical contacts being enclosed within the thermal switch module's substantially cylindrical outer case 114.

The adapter 112 is illustrated as a "cup" or "hat" shaped flanged adapter having a mounting apparatus 116 configured as a pair of wings for securing the thermal switch apparatus 100 of the invention to a surface whose temperature is to be measured. However, the adapter 112 of the invention is advantageously provided with mounting apparatus having alternative adaptive traits, including for example an annular flange, a stud, a tube, strap or a clamp to name just a few.

According to one embodiment of the invention, the thermal switch module 110 and adapter 112 have mating respective male and female structures. Accordingly, the male thermal switch module 110 is structured with a relief 118 formed in the external surface of the outer case 114. The adapter 112 includes a tubular receptacle 120 that is formed of a resilient metallic material having a good coefficient of thermal conductivity, such as aluminum, brass, tin, or steel. As shown, the tubular receptacle 120 is formed integrally with the mounting apparatus 116, but the tubular receptacle 120 and apparatus 116 are optionally formed separately and joined together as by welding, soldering, brazing or another conventional metal joining operation. The tubular receptacle 120 is sized with an inner diameter that provides at least a sliding fit or a slightly more generous fit with the outer case 114 of the thermal switch module 110.

The tubular receptacle 120 has an internal surface 122 that is formed with a retainer 124 structured to mate with the relief 118 on the external surface of the thermal switch module's outer case 114. As illustrated in FIG. 4, the relief 118 on the male thermal switch module 110 is configured as a plurality of small, shallow indentations or hollow clefts 126 formed in the external surface of the outer case 114. The retainer 124 is configured as a plurality of prongs or "fingers" 128 that are bent or shaped to extend from the internal surface 122 of the tubular receptacle 120 and project inward at a small angle so that the tips 130 of the prongs 128 lie approximately on a circle that is of smaller diameter than the outside diameter of the outer case 114 of the thermal switch module 110. Furthermore, the slightly angled prongs 128 point generally along the longitudinal axis A toward an end cap 132 that closes one end of the tubular receptacle 120. As illustrated in FIG. 4, the end cap 132 is integral with a substantially planar structure that includes the winged mounting apparatus 116.

Ideally, the indentations 126 that form the relief 118 of the thermal switch module's outer case 114 shallow, dipping only slightly below the case's external surface 134. Furthermore, the indentations 126 are equally spaced around the periphery of the outer case 114, and each is formed having a width, as measured along the circumference of the case's external surface 134, only slightly larger than a corresponding prong 128. A bottom lip 136 is equally spaced from a base 138 of the outer case 114, which is also the primary sensing surface of the thermal switch module 110.

The prongs 128 that form the retainer 124 extending from the internal surface 122 of the tubular receptacle 120 are equal in number to the indentations 126 on the thermal switch module 110 and are equally spaced around the periphery of the internal surface 122. All of the prongs 128 are configured such that their tips 130 are spaced away from the inner surface of the end cap 132 a distance that is at least equal to or slightly greater than the distance between the lips 136 of the indentations 126 and the base 138 of the outer case 114. The prongs 128 are thus positioned to enter and interfit with corresponding indentations 126 on the outer case 114 when the thermal switch module 110 is introduced into the tubular receptacle 120.

Figure 5:
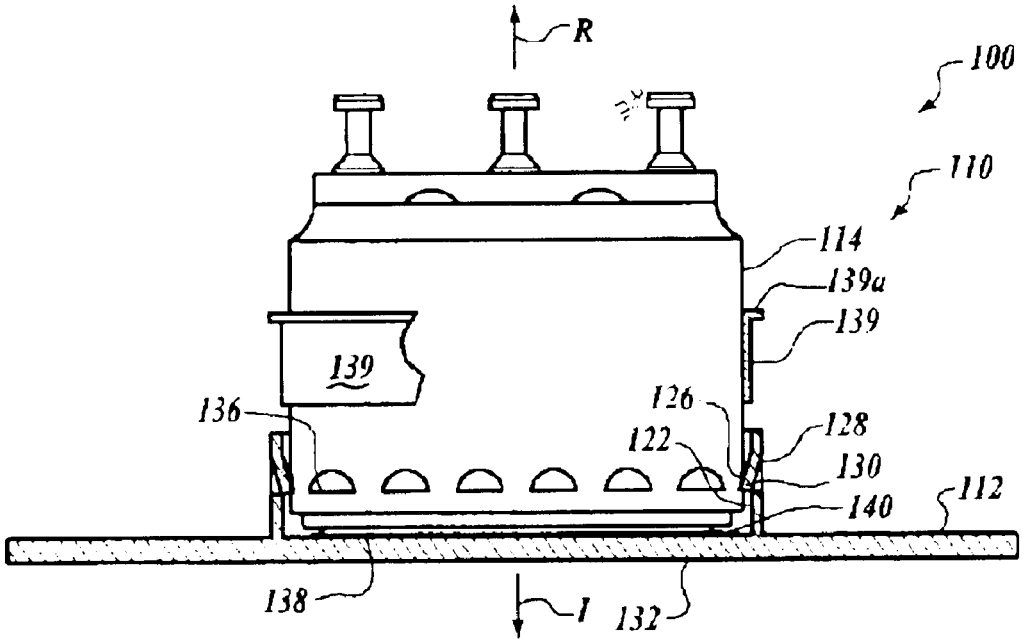
FIG. 5 is a side view of the assembled thermal switch apparatus of the invention which illustrates the interlocking of a retainer portion of the adapter with a relief portion of the modular thermal switch device.

FIG. 5 illustrates that, when the thermal switch module 110 is introduced into the tubular receptacle 120 of the adapter 112, the prongs 128 are compressed outwardly toward the internal surface 122 of the tubular receptacle 120 sufficiently to allow the thermal switch module's outer case 114 to pass between the prongs 128 toward the adapter's end cap 132. When the outer case 114 is inserted far enough into the tubular receptacle 120, the prongs intersect with the indentations 126. As soon as the tips 130 of the prongs 128 pass over the lips 136 of the indentations 126, the resilient prong material causes the prongs 128 to expand from their compressed state and spring with a snapping action into the hollow clefts provided by the indentations 126. The prongs 128 thus capture the thermal switch module 110 within the tubular receptacle 120 of the adapter 112 with the prong tips 130 pressing against the indentations' lips 136 to hold the thermal switch module's base 138 against the interior surface of the adapter's end cap 132. The interlocking of the retainer 124 with the relief 118 thus firmly and permanently secures the male case 114 of the thermal switch module 110 within the female tubular receptacle 120 of the adapter 112. The prongs 128 fitting inside the indentations 126 eliminate any possibility of the thermal switch module 110 rotating relative to the adapter 112.

FIG. 5 also illustrates a tool 139 for detaching the thermal switch module 110 from the adapter 112. The tool 139 is, for example, a thin walled tube sized to fit over the case 114 and the within the tubular receptacle 120. The tool 139 is pressed into the space between the thermal switch module 110 and the adapter 112. The tool 139 engages the prongs 128 and compresses them back into the internal surface 122 of the tubular receptacle 120. The prongs 128 are thereby disengaged from the indentations 126, and the thermal switch module 110 is released and may be removed from the adapter 112 for repair or replacement by retraction along a line of retraction R opposite in direction from a line of insertion I. The tool 139 may include an annular upper lip 139*a* for ease of engagement with a pressure applicator (not shown), such as an assembly worker's hand or a mechanical press.

FIG. 5 also illustrates placement of a thermally conductive interface 140 between the surface of the temperature sensing base 138 of the thermal switch module 110 and the inner surface of the adapter's end cap 132. The thermally conductive interface 140 is, for example, a known thermally conductive grease that is useful for thermal coupling of electronic chips and heat sinks in electronic modules. One such thermally conductive grease is disclosed by U.S. Pat. No. 5,250,209, entitled THERMAL COUPLING WITH WATER-WASHABLE THERMALLY CONDUCTIVE GREASE, which was issued to Jamison, et al. on Oct. 5, 1993, the complete disclosure of which is incorporated herein by reference. Other suitable thermally conductive greases are known and are considered equivalents that are similarly contemplated by the invention. The thermally conductive interface 140 is known to increase heat transfer between contacting surfaces, thereby reducing thermal lag between the surface whose temperature is to be measured and the thermal switch module 110.

Alternatively, the thermally conductive interface 140 is a thermally conductive adhesive interface. One such thermally conductive adhesive is disclosed by U.S. Pat. No. 5,591,034, entitled. THERMALLY CONDUCTIVE ADHESIVE INTERFACE, which was issued to Ameen, et al. on Jan. 7, 1997, the complete disclosure of which is incorporated herein by reference. Other thermally conductive adhesives are known and are considered equivalents that are similarly contemplated by the invention.

Figure 1:
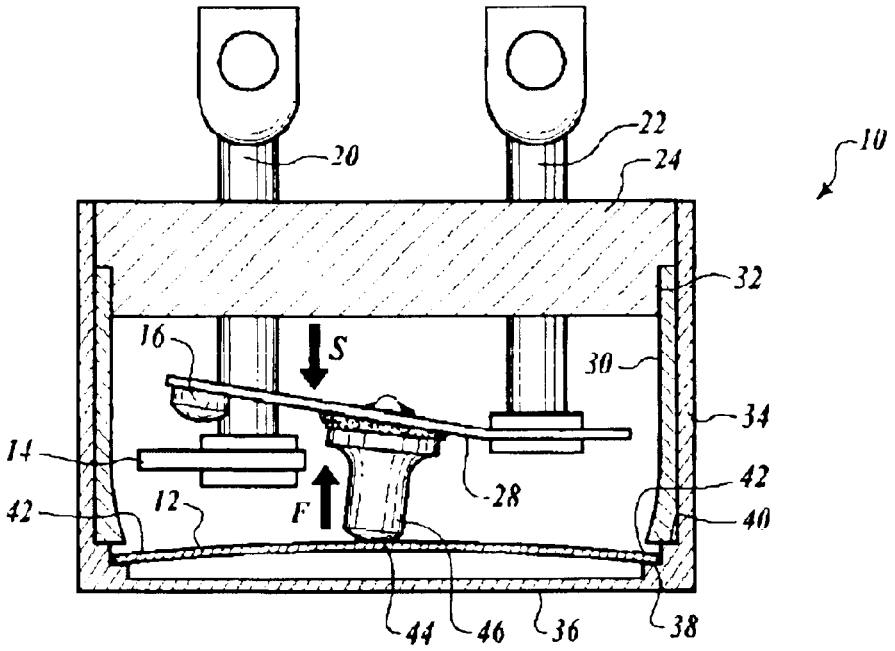
Fig. 1. (PRIOR ART)
FIG. 1 is a cross-sectional view of one known bi-metallic thermal switch device having a bi-metallic disc actuator positioned to drive relatively movable electrical contacts.
Figure 2:
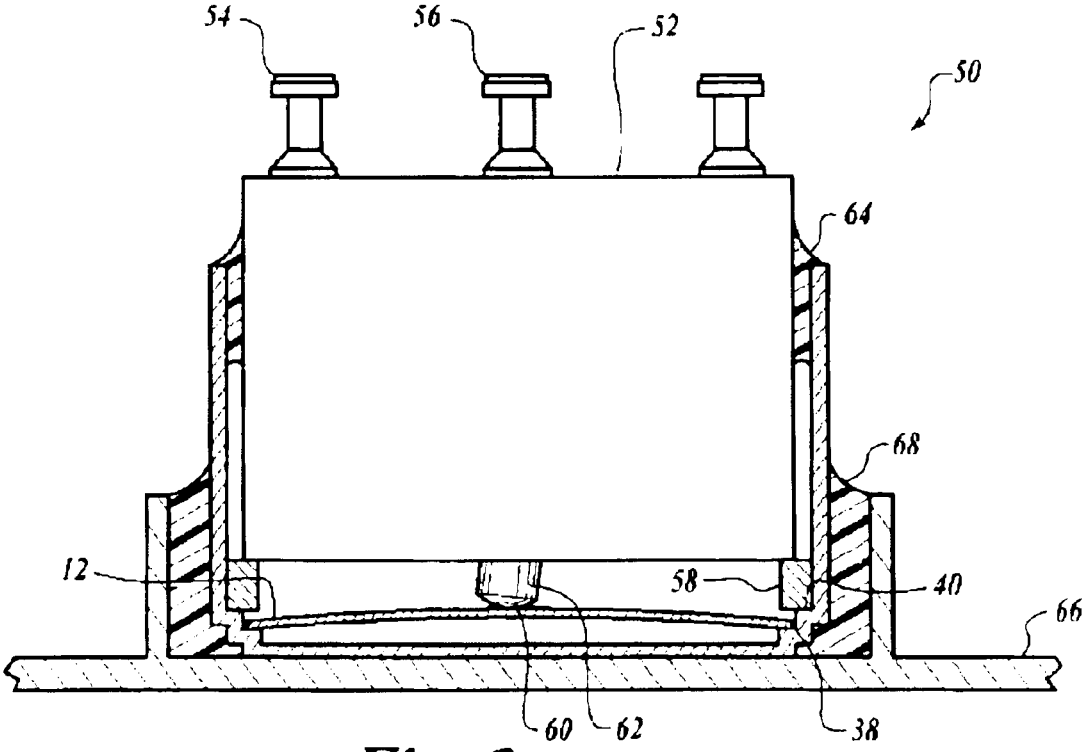
Fig. 2. (PRIOR ART)
FIG. 2 is a cross-sectional view of another known bi-metallic thermal switch device having the bi-metallic disc actuator positioned to drive relatively movable electrical contacts of a conventional microswitch.
Figure 6:
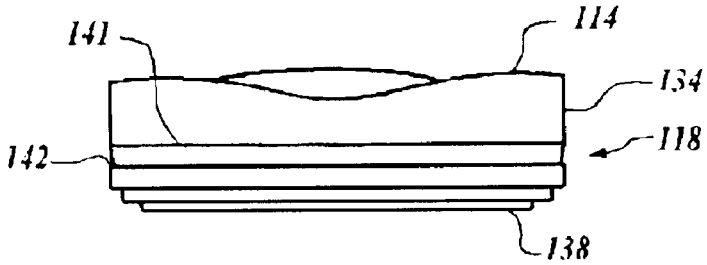
FIG. 6 illustrates one alternative embodiment of the relief formed in the external surface of the male case of the modular thermal switch device, wherein the relief is embodied as a small annular recess formed in the external surface of the outer case adjacent to, but spaced away from a base sensing surface.
Figure 7:
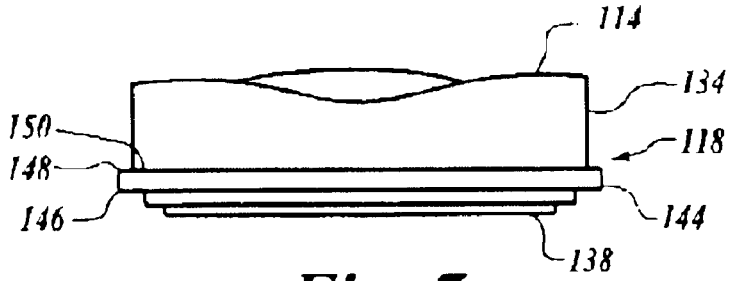
FIG. 7 illustrates another alternative configuration of the relief formed in the external surface of the male case of the modular thermal switch device, wherein a slight annular protrusion or "flare" is provided on the case's external surface adjacent to, but spaced away from the base sensing surface.

FIGS. 6 and 7 each illustrate alternative configurations of the relief 118 formed in the external surface 134 of the male case 114 of the thermal switch module 110. In FIG. 6 the relief is configured as a small annular recess 141 formed in the external surface of the outer case 114 adjacent to, but spaced away from the base 138, so that the annular steps or lands 38 and 40 around the interior of the case 114 can be properly formed, as shown in FIGS. 1 and 2 and described above. The annular recess 141 permits the thermal switch module 110 to be inserted into the tubular receptacle 120 without regard for rotational orientation relative to the prongs 128. The prongs 128 are able to enter and interlock with the annular recess 141 at any point along the circumference with the prong tips 130 fitting over a bottom annular lip 142 spaced above the base 138 of the outer case 114. The spring pressure of the plurality of prongs 128 against the case's external surface 134 is believed to be strong enough to maintain relative rotational orientation between the thermal switch module 110 and its adapter 112. However, additional rotational holding power is gained when the tips 130 of the prongs 128 are cut or formed with a sharp edge or corner at their intersection with the case's external surface 134, so that anti-rotational friction is maximized.

FIG. 7 is another alternative configuration of the relief 118 whereby a slight annular protrusion or "flare" 144 is provided on the case's external surface 134 adjacent to, but spaced away from the base 138, so that the annular steps or lands 38 and 40 around the interior of the case 114 can be properly formed, as shown in FIGS. 1 and 2 and described above. The flare 144 can be accomplished for example by hydroforming the metallic case 114. Additionally, an inner surface of the flare 144 can be used to form the upper case land 40, shown in FIGS. 1 and 2, which the spacer rings 30 (FIG. 1) and 58 (FIG. 2) abut to form the annular groove in which is captured the peripheral edge portion 42 of the disc actuator 12.

The annular flare 144 operates similarly to the annular recess 141 shown in FIG. 6 and described above. The annular flare 144 permits the thermal switch module 110 to be inserted into the tubular receptacle 120 without regard for rotational orientation relative to the prongs 128. The prongs 128 are able to slide past a bottom lip 146 of the annular flare 144 and interlock with a top lip 148 and top surface 150 of the annular flare 144 and the external surface 134 of the case 114. The prongs 128 can interlock with the annular flare 144 and the case's external surface 134 at any point along the circumference of the case 114 without regard for rotational orientation. The spring pressure of the plurality of prongs 128 is believed capable of maintaining relative rotational orientation between the thermal switch module 110 and its adapter 112. However, a sharp edge or corner on the tips 130 of the prongs 128 can add additional rotational holding power.

The annular flare 144 increases the overall outside case diameter. In response, the inner diameter of the tubular receptacle 120 is increased to provide sufficient clearance for the case 114 to enter with at least a slip or sliding fit.

Figure 8:
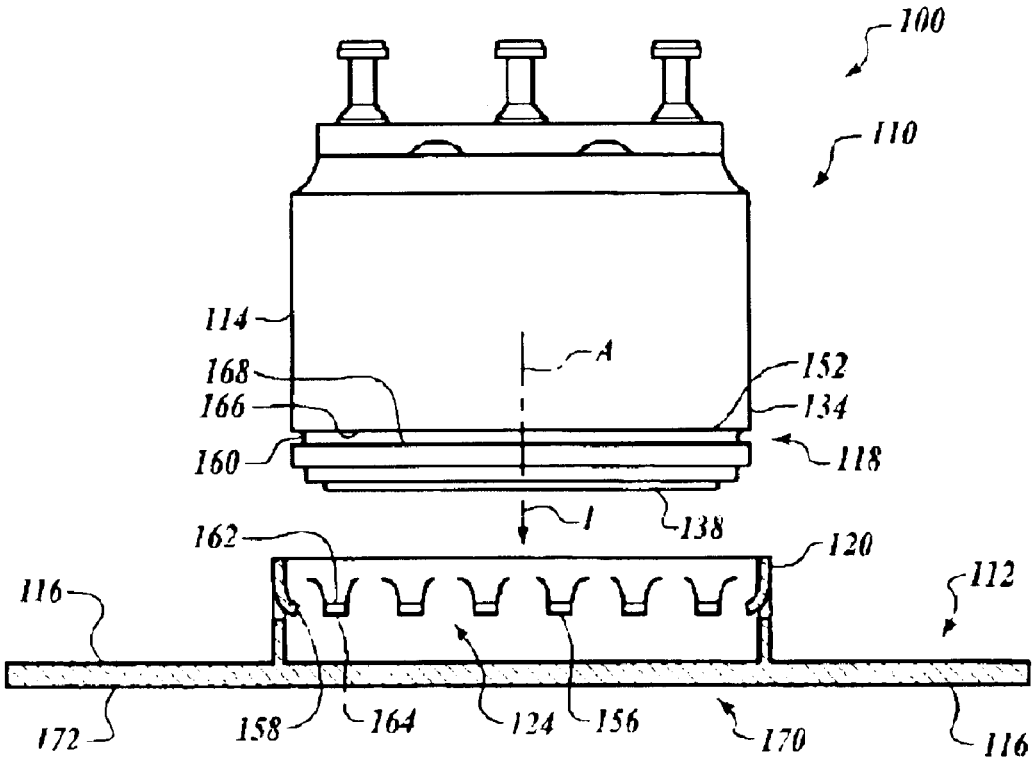
FIG. 8 illustrates yet another alternative embodiment of the relief formed in the external surface of the male case of the modular thermal switch device, wherein a narrow and shallow annular recess is formed in the external surface of the outer case adjacent to, but spaced away from the base sensing surface.

FIG. 8 illustrates yet another alternative embodiment of the relief 118 whereby a narrow and shallow annular recess 152 is formed in the external surface 134 of the outer case 114 adjacent to, but spaced away from the base 138, so that the annular steps or lands 38 and 40 around the interior of the case 114 can be properly formed, as shown in FIGS. 1 and 2 and described above. The annular recess 152 is about the same or slightly wider than the thickness of the material forming the wall 154 of the tubular receptacle 120.

The interlocking retainer 124 is formed as a plurality of prongs 156 that are regularly spaced around the periphery of the internal surface 122 of the tubular receptacle 120. Each of the prongs 156 includes a tip 158 that is pointed generally inwardly toward the center of the tubular receptacle 120.

The prong tips 158 are thus structured to enter and interlock with the annular recess 152 at any point along the circumference of the outer case 114. The annular recess 152 permits the thermal switch module 110 to be inserted along the insertion axis I into the tubular receptacle 120 without regard for rotational orientation relative to the interlocking prongs 156. The spring pressure of the plurality of prongs 156 press the prong tips 158 against the shallow inner wall 160 of the annular recess 152 to maintain relative rotational orientation between the thermal switch module 110 and its adapter 112. The upper and lower surfaces 162, 164 of the prong tips 158 engage respective upper and lower surfaces 166, 168 of the narrow annular recess 152. Engagement of the prong tips' upper and lower surfaces 162, 164 with respective upper and lower surfaces 166, 168 of the annular recess 152 fix the relative positions of the thermal switch module 110 and adapter 112 along the longitudinal axis A. Accordingly, the relief 118 in the form of the annular recess 152 captures the retainer 124 in the form of the prongs 156 to constrain relative longitudinal motion.

The need for a base plate, such as the end cap 132 shown in FIGS. 3–5, to cooperate with the prongs 128 in capturing the case 114 is thus eliminated. As shown in FIG. 8, the tubular receptacle 120 can thus be left open at both ends. The opening 170 in the end of the adapter 112 that engages the surface to be measured thus permits the base 138 of the thermal switch module 110 to engage the surface whose temperature is to be measured without interference from the end cap 132, thereby eliminating any time lag that may be associated with the extra material between the sensing surface 138 of the thermal switch module 110 and the surface to be measured. Furthermore, because the temperature sensing base surface 138 of the thermal switch module 110 is exposed directly to the surface to be measured, the constraints on the material used to form the adapter 112 are relaxed; the adapter 112 no longer needs to conduct heat or cold from the surface to be measured to the base surface 138 of the thermal switch module 110. Therefore, the material used to form the adapter 112 need not be thermally conductive, nor even metallic.

Furthermore, the relief 118 can be positioned differently along the length of the case 114 so that the position of the base sensing surface 138 is positioned differently along the longitudinal axis of the adapter's tubular receptacle 120. The sensing surface 138 can thus be positioned to be co-planar with a mounting surface 172 of the adapter 112. Alternatively, the thermal switch module 110 can be positioned with its sensing surface 138 either extending beyond the mounting surface 172 or retracted into the tubular receptacle 120 as appropriate for different thermal response designs.

Figure 9:
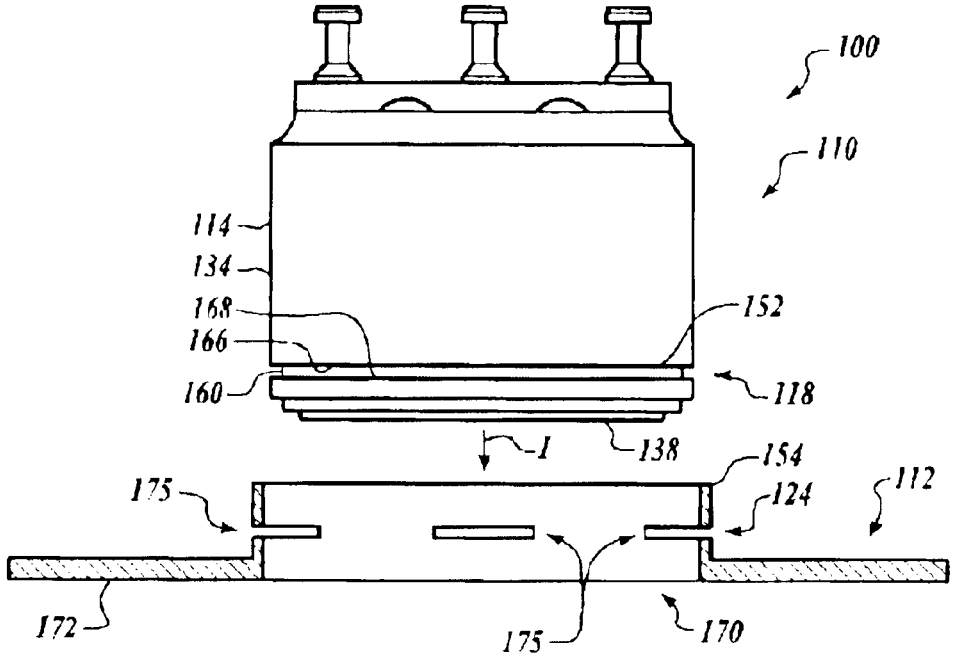
FIG. 9 illustrates still another alternate embodiment of the invention, wherein the interlocking retainer of the invention is configured as a plurality of slots spaced around the wall of the tubular receptacle portion of the adapter.

FIG. 9 illustrates still another alternate embodiment of the invention, wherein the interlocking retainer 124 is configured as a plurality of two, three or more slots 175 through the wall 154 of the tubular receptacle 120 portion of the adapter 112, the slots 175 being spaced around the periphery of the tubular receptacle 120 and spaced a predetermined distance away from the mounting surface 172 of the adapter 112, which contains the opening 170, as described above. The slots 175 are structured to accept a snap ring 176 (shown in FIG. 10). The relief 118 is the narrow and shallow annular recess 152, shown in FIG. 8 and described above, that is formed in the external surface 134 of the outer case 114 adjacent to, but spaced away from the base 138. The upper and lower surfaces 166, 168 of the annular recess 152 are spaced apart about the same width as the slots 175 in the tubular receptacle wall 154. The annular recess 152 permits the thermal switch module 110 to be inserted into the tubular receptacle 120 without regard for rotational orientation relative to the mounting apparatus portion 116 of the adapter 112.

Figure 10:
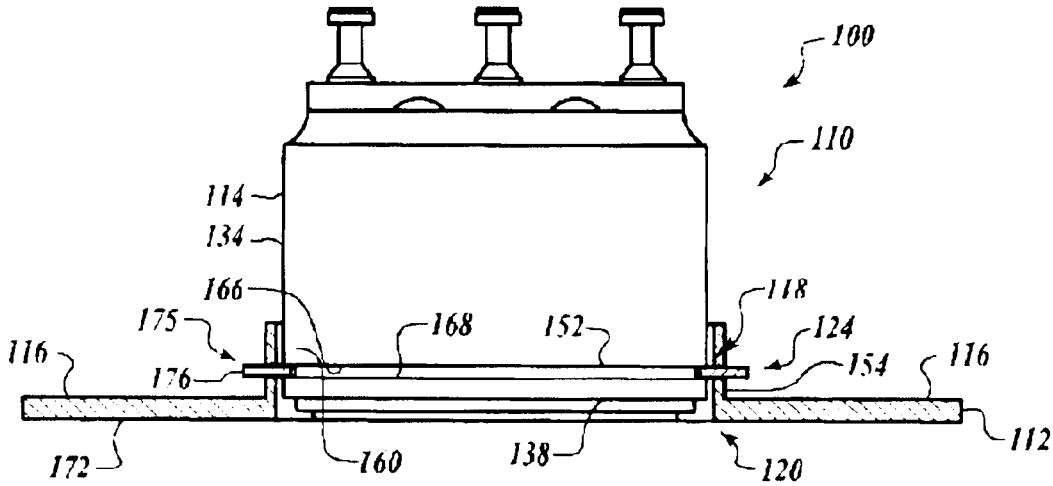
FIG. 10 illustrates the embodiment of FIG. 9 having modular thermal switch device installed in the adapter with a snap ring inserted through the slots that form the retainer and into an annular recess that forms the relief.

FIG. 10 illustrates the configuration of FIG. 9 having the thermal switch module 110 installed in the adapter 112 with the snap ring 176 inserted through the slots 175, which form the retainer 124, into the annular recess 152, which forms the relief 118. The snap ring 176 operates to interlock the relief 118 with the retainer 124, thereby securing the thermal switch module 110 within the adapter 112 with the sensing surface 138 longitudinally fixed relative to the opening 170 in the mounting apparatus 116. The snap ring 176 is a conventional snap ring formed of a resilient or spring-type material. Accordingly, the snap ring 176 is removable from the slots 174 whereupon the thermal switch module 110 may be removed from the adapter 112 for repair or replacement.

As described in relation to FIG. 8, the annular recess 152 of the relief 118 can be positioned differently along the length of the case 114 so that the position of the base sensing surface 138 is positioned differently along the longitudinal axis of the adapter's tubular receptacle 120. The sensing surface 138 can thus be positioned to be co-planar with a mounting surface 172 of the adapter 112, extended beyond the mounting surface 172, or retracted into the tubular receptacle 120, as appropriate for different thermal response designs.

The longitudinal position of the slots 175 of the retainer portion 124 of the adapter 112 is alternatively varied relative to the mounting surface 172 so that the sensing surface 138 is positioned co-planar with the mounting surface 172, extended beyond the mounting surface 172, or retracted into the tubular receptacle 120, as desired.

Figure 11:
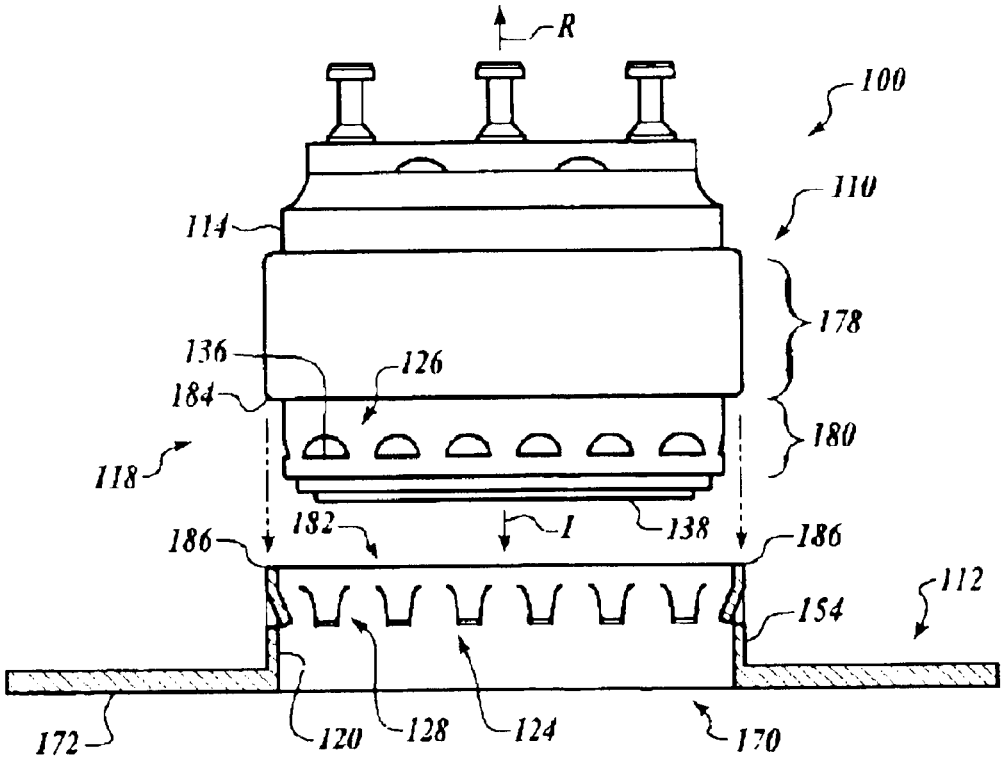
FIG. 11 illustrates yet another alternative embodiment of the thermal switch apparatus of the invention, wherein the substantially tubular receptacle of the adapter is open-ended.

FIG. 11 illustrates yet another alternative embodiment of the thermal switch apparatus 100 of the invention, wherein the end portion of the thermal switch module's case 114 includes the relief 118 configured as the plurality of indentations 126 shown in FIG. 4 and described above. The adapter 112 includes the retainer 124 formed on the internal surface 122 of the tubular receptacle 120 configured as the plurality of prongs 128 pointing slightly inwardly and generally downwardly toward the opening 170 in the mounting surface of the adapter 112. The interlocking indentations 126 and prongs 128 effectively retain the thermal switch module 110 within adapter 112 when the prongs 128 expand inwardly of the external surface of the case 114 and enter the indentations 126. The spring pressure of the resilient prongs 128 against the lip 136 inner wall of the indentations 126 securely restrain the case 114 from retracting from the tubular receptacle 120 of the adapter 112. The other embodiments of the relief 118 illustrated in FIGS. 6 and 7 also cooperate with the prong-type retainer 124 to secure the thermal switch module 110 against retraction out of the tubular receptacle 120 of the adapter 112. Therefore, those embodiments of the relief 118 illustrated in FIGS. 6 and 7 are considered equivalent to the indentations 126 for purposes of the invention.

When configured as any of the indentations 126, the annular recess 141 (FIG. 6) and the annular protrusion or flare 144 (FIG. 7), the relief 118 primarily operates in combination with the prongs 128 to secure the thermal switch module 110 from retraction from the adapter's tubular receptacle 120 along the line of retraction R. In operation, the base 138 of the thermal switch module's case 114 abuts the inside surface of the adapter's end cap 132. The thermal switch module's case 114 is thereby securely captured in the adapter's tubular receptacle 120 between the prongs 128 and the end cap 132. However, only the end cap 132 constrains the thermal switch module 110 from passing through the tubular receptacle 120 along the insertion axis I and out of the adapter 112.

The embodiment of FIG. 11 includes the adapter 112 embodied with the retainer 124 configured as the plurality of prongs 128, and the tubular receptacle 120 configured with the opening 170 in its base. An expanded portion 178 of the thermal switch module's case 114 is enlarged to have an outside diameter greater than the inside diameter of the tubular receptacle 120. The expanded portion 178 is, for example, as large as the outside diameter of the tubular receptacle 120 and is spaced away from the sensing surface 138 with a portion 180 therebetween sized to pass through the entry opening 182 and into the tubular receptacle 120 and includes the relief 118. The expanded portion 178 cannot pass through the entry opening 182 into the tubular receptacle 120. Rather, as the case 114 is inserted along the insertion line I through entry opening 182 into the tubular receptacle 120, a bottom lip 184 of the expanded portion 178 adjacent to the normal sized portion 180 of the case 114 intercepts and interferes with a top lip 186 of the tubular wall 154. The tubular wall 154 thus operates as a stop against which the expanded portion 170 rests. The thermal switch module 110 is thus captured in the tubular receptacle 120 of the adapter 112 by the interlocking relief 118 cooperating with the retainer 124 to resist retraction and by the expanded portion 178 cooperating with the tubular wall 124 to resist further insertion.

Figure 12:
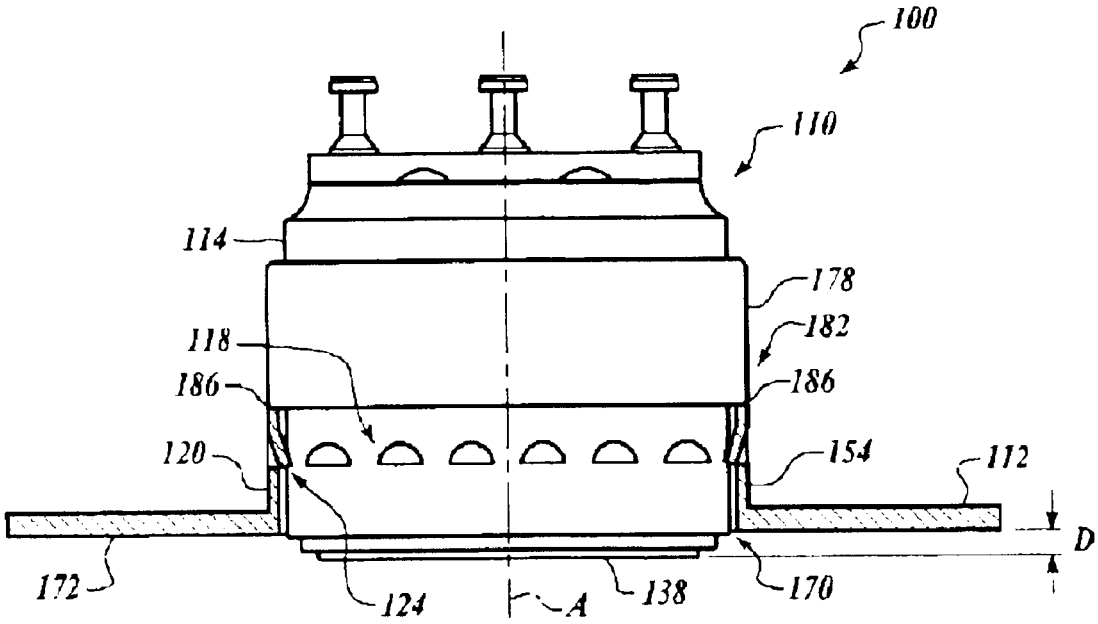
FIG. 12 illustrates the embodiment of FIG. 11 having the modular thermal switch device installed in the open-ended tubular receptacle of the adapter and extending a distance D beyond the mounting apparatus.

FIG. 12 illustrates that the expanded portion 178 is positioned to cooperate with the length of the tubular wall 154 to fix the position of the sensing surface 138 of the thermal switch module 110 relative to the mounting surface 172. The position of the expanded portion 178 along the longitudinal axis A of the case 114 combines with the position of the top lip 186 of the receptacle wall 154 relative to the adapter's mounting surface 172 to position the sensing surface 138 either above, co-planar with, or a distance D below the adapter's mounting surface 172, as shown in FIG. 12. The sensing surface 138 may thereby be extended for more direct measurement into a recess in a surface whose temperature is to be measured, or into a stream of gas or fluid whose temperature is to be measured. Alternatively, the sensing surface 138 can be withdrawn from the actual surface or stream, thereby building in a time lag in the sensor's response. The sensing surface 138 can also be fixed co-planar with the mounting surface 172 so that it contacts a flat surface that contains the mounting platform for the thermal switch apparatus 100 of the invention.

Figure 13:
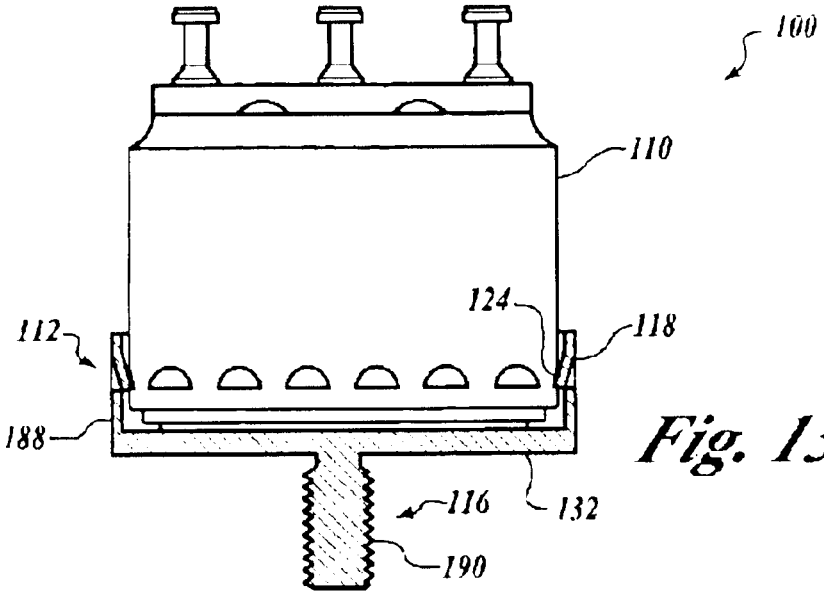
FIG. 13 illustrates one embodiment of the thermal switch apparatus of the invention wherein the modular thermal switch device is installed in the adapter of the invention embodied having a studded mounting apparatus.

FIG. 13 illustrates one embodiment of the thermal switch apparatus 100 of the invention wherein the thermal switch module 110 is installed in the adapter 112, which is embodied having a studded mounting apparatus 116. The studded adapter 112 includes the retainer 124 interlocking with the thermal switch module's relief 118 to securely retain the thermal switch module 110. The studded adapter 112 also includes a cup shaped case 188 having a threaded stud 190 extending from the surface of the end cap 132. The stud 190 is useful for attaching the thermal switch apparatus 100 to a surface whose temperature is to be measured. The stud 190 can be sized larger or smaller to match different applications.

Figure 14:
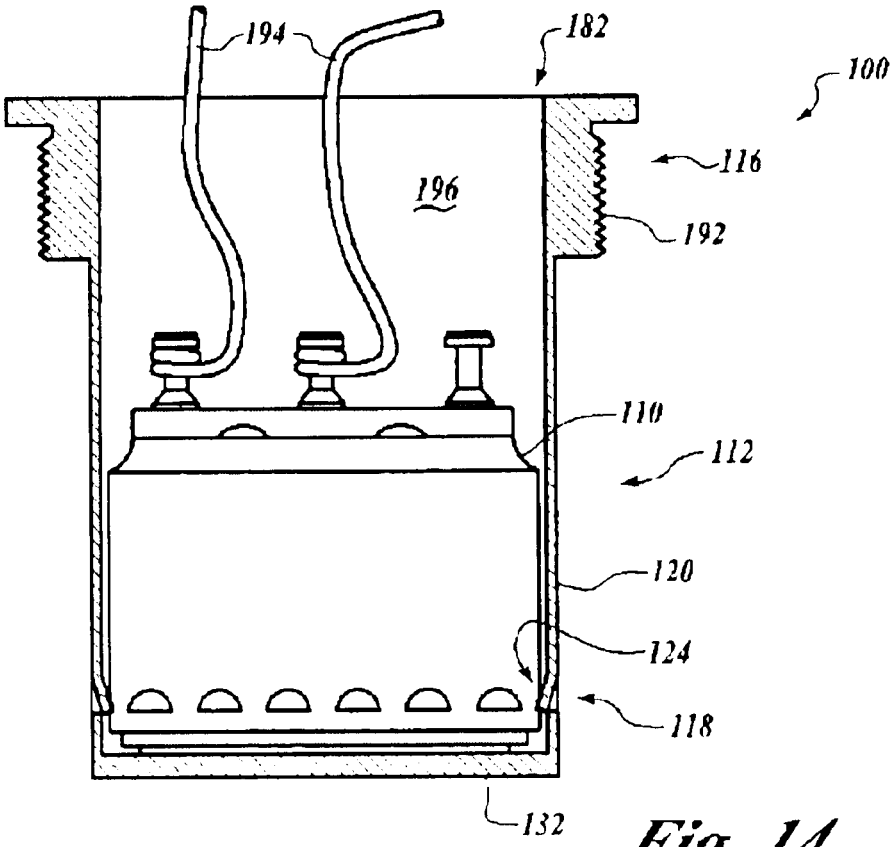
FIG. 14 illustrates another embodiment of the thermal switch apparatus of the invention wherein the modular thermal switch device is installed in the adapter of the invention embodied having an elongated tubular receptacle extending from a threaded interface.

FIG. 14 illustrates another embodiment of the thermal switch apparatus 100 of the invention wherein the thermal switch module 110 is installed in the tubular receptacle 120 of the adapter 112, which is embodied as an elongated tubular receptacle 120. The elongated tubular receptacle 120 includes the retainer 124 adjacent to its end cap 132 for interlocking with the thermal switch module's relief 118. The adapter 112 includes a mounting mechanism illustrated as a threaded portion 192 positioned near the mouth of the entry opening 182 into the elongated tubular receptacle 120 through which the thermal switch module 110 is installed. Electrical conductors or "pig tails" 194 are provided for connecting the thermal switch apparatus 100 into an electrical circuit. The portion 196 of the elongated tubular receptacle 120 above the thermal switch module 110 is optionally filled with a nonconductive potting or overmolding compound (not shown) for environmental protection of the thermal switch module 110. In use, the elongated tubular receptacle 120 portion of the adapter 112 is passed through a hole in a body whose temperature is to be measured, or through the wall of a tube or pipe housing a gas or liquid whose temperature is to be measured. The elongated tubular receptacle 120 is thus optionally provided in a variety of lengths, with a variety of mounting apparatus 116, including the threaded version illustrated.

While the preferred embodiment of the invention has been illustrated and described, it will be appreciated that various changes can be made therein without departing from the spirit and scope of the invention. For example, the different configurations of relief 118 and retainer 124 can be interchanged among the different embodiments illustrated in the Figures. In another example, each of the embodiments including the tubular receptacle 120 having the double openings 170, 182 can be easily restructured to position the sensing surface 138 of the thermal switch module 10 above, below, or co-planar with the mounting surface 172 of the adapter 112. In yet another example, the adapter 112 itself is alternatively formed with an extension, such as an elongated tubular receptacle 120, that positions the end cap 132 of the adapter 112 below the nominal mounting surface 172, whereby the sensing surface 138 of the thermal switch module 110 is also positioned below the mounting surface 172.

Therefore, it is to be understood that the invention is not limited to the specific embodiments disclosed, and that modifications and other embodiments are intended to be included within the spirit and scope of the appended claims. Although specific terms are employed herein, they are used in a generic and descriptive sense only and not for purposes of limitation.

What is claimed is:

1. A thermal switch apparatus comprising:

an adapter having a mounting apparatus and a receptacle, the receptacle having a substantially fully cylindrical tubular female portion structured internally with a substantially annular retainer; and a thermal sensing device having a substantially fully cylindrical male portion sized to enter into the substantially cylindrical tubular female portion of the receptacle, the male portion having a substantially annular external relief structured to interlock with the substantially annular retainer.

2. The apparatus of claim 1 wherein the male portion of the thermal sensing device is installed in the female portion of the adapter with the external relief being interlocked with the retainer.

3. The apparatus of claim 1 wherein:

the external relief of the thermal sensing device further comprises one or more recesses receded into an external surface of the male portion; and the retainer of the adapter further comprises one or more projections extending inwardly of an interior wall portion of the receptacle.

4. The apparatus of claim 1 wherein the retainer further comprises an integral portion of the female portion of the receptacle.

5. The apparatus of claim 1 wherein the retainer is further positioned adjacent to one end of the female portion of the receptacle.

6. The apparatus of claim 1 wherein the female portion of the receptacle is closed at one end thereof.

7. A thermal switch apparatus comprising:

a thermal sensing device housed in a case, a portion of an external surface of the case being structured with one or more juxtaposed relatively raised and recessed areas; and a mounting adapter including an integral mounting apparatus and a substantially tubular receptacle, an internal wall portion of the receptacle being structured with a plurality of inwardly projecting retainer portions engaging and interlocking with the one or more juxtaposed relatively raised and recessed areas of the case.

8. The thermal switch apparatus of claim 7 wherein the tubular receptacle of the mounting adapter is closed at one end thereof by an integral end cap, and the plurality of retainer portions are further positioned adjacent to the one closed end of the receptacle.

9. The thermal switch apparatus of claim 8 wherein the one or more juxtaposed relatively raised and recessed areas further comprise a plurality of indentations formed in the external surface of the case, and the inwardly projecting retainer portions further comprise a cooperating plurality of prongs projecting inwardly of the receptacle and toward the one closed end of the receptacle.

10. The thermal switch apparatus of claim 7 wherein the inwardly projecting retainer portions springingly engage the one or more juxtaposed relatively raised and recessed areas of the case.

11. The thermal switch apparatus of claim 7 wherein the thermal sensing device further comprises a bimetallic disc actuator in operative relationship with a pair of relatively moveable electrical contacts.

12. A thermal switch apparatus comprising:

a means for indicating a change in temperature;

a means for adapting the indicating means to a predetermined apparatus; and a means for interlocking the indicating means with the adapting means.

13. The thermal switch apparatus of claim 12 wherein the interlocking means further comprises snapping means.

14. The thermal switch apparatus of claim 12 wherein the interlocking means further comprises first and second cooperating interlocking means, the indicating means including the first cooperating interlocking means and the adapter means including the second cooperating interlocking means.

15. The thermal switch apparatus of claim 12 wherein the means for interlocking the indicating means with the adapting means further comprises means for securing a portion of the indicating means against an internal surface of the adapting means.

16. The thermal switch apparatus of claim 12 wherein the interlocking means further comprises means for applying spring pressure against an external surface of the indicating means.

17. A thermal switch apparatus comprising:

a thermal switch module having a pair of relatively moveable electrical contacts and a thermally responsive actuator that is operatively positioned for actuating the electrical contacts at a predetermined set-point temperature, the thermally responsive actuator and electrical contacts being enclosed within a substantially cylindrical outer case having a relief portion structure formed on an external surface thereof; and an adapter having a mounting apparatus coupled to a substantially tubular receptacle, the receptacle having an inside diameter larger than an outside diameter of the outer case of the thermal switch module and an internal surface that is formed with an integral retainer portion structured to mate with the relief portion on the external surface of the outer case.

18. The thermal switch apparatus of claim 17 wherein the thermal switch module is installed into the receptacle of the adapter, the retainer portion on the internal surface of the receptacle being mated with the relief portion on the external surface of the outer case.

19. The thermal switch apparatus of claim 17 wherein the relief portion on the external surface of the outer case further comprises a plurality of recessed areas, and the retainer portion on the internal, surface of the receptacle further comprises a plurality of inwardly projecting retainers, each of the inwardly projecting retainers being interlockingly mated with one of the recessed areas.

20. The thermal switch apparatus of claim 17 wherein the relief portion on the external surface of the outer case further comprises a plurality of indentations, and the retainer portion on the internal surface of the adapter receptacle further comprises a plurality of resilient prongs structured to interlock with the indentations.

21. The thermal switch apparatus of claim 17 wherein:

the outer case of the thermal switch module further comprises a thermal sensing surface positioned at one end thereof;

the relief portion on the external surface of the outer case is spaced away from the thermal sensing surface;

the receptacle of the adapter further comprises an integral end cap closing one end of the receptacle; and the plurality of resilient prongs is adjacent to but spaced away from an internal surface of the end cap.

* * * * *